US011045015B2

(12) United States Patent
Lee

(10) Patent No.: US 11,045,015 B2
(45) Date of Patent: Jun. 29, 2021

(54) SELF-SERVICE DEVICE FOR TAKING TABLEWARE

(71) Applicant: Kolor Magnetic (Shenzhen) Co., Ltd., Guangdong (CN)

(72) Inventor: Ching Mou Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 428 days.

(21) Appl. No.: 16/303,810

(22) PCT Filed: Aug. 14, 2018

(86) PCT No.: PCT/CN2018/100448

§ 371 (c)(1),
(2) Date: Nov. 21, 2018

(87) PCT Pub. No.: WO2019/119830

PCT Pub. Date: Jun. 27, 2019

(65) Prior Publication Data

US 2021/0153668 A1 May 27, 2021

(30) Foreign Application Priority Data

Dec. 19, 2017 (CN) ..... 201711376112.7

(51) Int. Cl.
*A47F 1/10* (2006.01)
*A47G 21/00* (2006.01)

(52) U.S. Cl.
CPC ..... *A47F 1/10* (2013.01); *A47G 21/00* (2013.01)

(58) Field of Classification Search
CPC ..... A47F 1/10; A47F 1/08; A47F 1/06; A47F 2001/103; A47G 21/00
See application file for complete search history.

(56) References Cited

U.S. PATENT DOCUMENTS 2,141,684 A * 12/1938 Diemer ..... A47F 1/10 221/239
2,149,099 A * 2/1939 Phinney ..... A47F 1/10 221/6
2,189,544 A * 2/1940 Cramp ..... A47F 1/10 221/186

(Continued)

FOREIGN PATENT DOCUMENTS

CN 204617801 U 9/2015

*Primary Examiner* — Ko H Chan

(57) ABSTRACT

A self-service device for taking tableware is provided, comprising a housing body in which a magazine for accommodating a plurality of tableware is arranged, and a support assembly for supporting the plurality of tableware arranged under the magazine, wherein the plurality of tableware are sequentially stacked on the support assembly. A pushing member is arranged at a side of the support assembly for pushing the tableware in a bottommost layer to displace relative to the support assembly for falling, wherein the pushing member is further provided with a reset member for resetting itself after its pushing. Moreover, an inclined chute is arranged in the housing body for receiving the tableware falling from the support assembly and guiding the same to slide out. The self-service device for taking tableware has a neat appearance, can be operated and taken out in a hermetically sealed environment, so the tableware is clean and hygienic.

18 Claims, 10 Drawing Sheets

(56) References Cited

U.S. PATENT DOCUMENTS

| | | | | | |
|---|---|---|---|---|---|
| 2,273,618 | A * | 2/1942 | Breyley | A47F 1/10 | 221/22 |
| 2,325,363 | A * | 7/1943 | Blake | A47F 1/10 | 221/130 |
| 2,462,394 | A * | 2/1949 | Heiman | A47F 1/10 | 221/266 |
| 4,896,792 | A * | 1/1990 | Marchand | G07F 11/10 | 221/103 |
| 6,832,694 | B2 * | 12/2004 | Goeking | A47F 1/10 | 221/195 |
| 9,049,948 | B2 * | 6/2015 | Jongen | H04W 4/023 | |
| 10,051,976 | B2 * | 8/2018 | Smith | B65D 83/0858 | |
| 2007/0193968 | A1 * | 8/2007 | Smith | A47F 1/10 | 211/70.7 |
| 2019/0150635 | A1 * | 5/2019 | Smith | B65D 83/0876 | |

* cited by examiner

SELF-SERVICE DEVICE FOR TAKING TABLEWARE

TECHNICAL FIELD

The present disclosure relates generally to tableware fields, and more particularly, to a self-service device for taking tableware.

BACKGROUND

At present, disposable tableware is more and more widely used in fast food restaurants, snack bars and families. However, there are problems such as the cleaning and sanitary problems due to the poor sealing of the containers which receive the tableware, and the waste problem resulted from taking out more tableware than one needs.

SUMMARY

The object of the present application is to provide a self-service device for taking tableware, aiming at the above problems of the prior art such as the cleaning and sanitary problems due to the poor sealing of the containers which receive the tableware, and the waste problem resulted from taking out more tableware than one needs.

In one aspect, a self-service device for taking tableware is provided, which comprising a housing body in which a magazine for accommodating a plurality of tableware is arranged, and a support assembly for supporting the plurality of tableware arranged under the magazine, wherein the plurality of tableware are sequentially stacked on the support assembly. In additional, a pushing member is arranged at a side of the support assembly for pushing the tableware in a bottommost layer to displace relative to the support assembly for falling, wherein the pushing member is further provided with a reset member for resetting itself after its pushing. Moreover, an inclined chute is arranged in the housing body for receiving the tableware falling from the support assembly and guiding the same to slide out.

In the self-service device for taking tableware according to one embodiment of the present application, the pushing member is further provided with a stopper for taking out the tableware falling onto the inclined chute by operating in linkage with the pushing member. Wherein, the stopper comprises a swinging rod swinging with the taking out of the tableware. One end of the swinging rod is connected with a stopping plate for holding a food taking part of the tableware during the taking out of the tableware and on which stopping plate, a recess hole is provided for passing through a handle of the tableware. The other end of the swinging rod far away from the stopping plate is connected with a linkage portion linked with the pushing member.

In the self-service device for taking tableware according to one embodiment of the present application, a shaft hole is opened on the linkage portion, wherein, the linkage portion is mounted on a fixed shaft through the shaft hole. The linkage portion is provided with a gear structure formed on its outer periphery, while the pushing member is provided with a chain structure meshing with the gear structure. Via the gear structure and the chain structure, the pushing member is brought to move by the stopper and the stopper is reset by a reset of the pushing member.

In the self-service device for taking tableware according to one embodiment of the present application, a pushing portion for pushing the tableware in a bottommost layer is formed on one end of the pushing member, while the reset member is connected at the other end of the pushing member far away from the pushing portion. Sliding portions are formed at both sides of the pushing member, wherein one sliding portion has a structure corresponding to the gear structure of the stopper, and the chain structure is formed at a lower end of the sliding portion corresponding to the gear structure of the stopper. A guiding chute adapting to an end of each sliding portion is formed inside the housing body.

In the self-service device for taking tableware according to one embodiment of the present application, the support assembly comprises a first bearing block for supporting a tail end of the handle of the tableware, a second bearing block and a third bearing block for supporting the food taking part of the tableware. The second bearing block and the third bearing block are respectively arranged in parallel at both sides under the food taking part of the tableware in the bottommost layer, while the first bearing block is arranged under the tail end of the handle of the tableware in the bottommost layer.

In the self-service device for taking tableware according to one embodiment of the present application, a guide groove is respectively arranged at both sides of the magazine, and the tableware is sequentially stacked along the guide grooves.

In the self-service device for taking tableware according to one embodiment of the present application, a first adjusting and stopping block is arranged at the lower end of the guide groove which is inserted into the tail end of the handle of the tableware. The first bearing block is located below the first adjusting and stopping block and a clearance space is formed between the first bearing block and the first adjusting and stopping block to insert the pushing member for pushing the tableware in the bottommost layer. The clearance space is mutually corresponding with the tail end of the handle of the tableware in the bottommost layer. A second adjusting and stopping block is arranged at the lower end of the guide groove which is inserted into a heat end of the food taking part of the inserted tableware.

A movement space for a displacement of the food taking part of the tableware in the bottommost layer is formed along a longitudinal direction between the second adjusting and stopping block and the second and third bearing blocks. The first adjusting and stopping block and the second adjusting and stopping block are both provided with a first fine adjustment structure for adapting the clearance space and the movement space with a tableware size.

In the self-service device for taking tableware according to one embodiment of the present application, the magazine is detachably installed inside the housing body. A detachment plate used for sending the stacked tableware into the magazine and then being detached is mounted at the bottom of the magazine, while a detachment hole for detaching the detachment plate is opened on the guide groove of the magazine.

In the self-service device for taking tableware according to one embodiment of the present application, the pushing member comprises a pushing rod having one end for pushing the tableware in a bottommost layer, and the other end far away from the tableware in a bottommost layer connected with a pushing button. A first inserting hole for inserting the pushing rod is formed on the linkage portion, a first abutting wall for abutting the pushing button is provided at one side of the linkage portion facing the pushing button, and a second abutting wall for abutting the reset member is provided at the other side of the linkage portion away from the pushing button. The magazine is provided with a third abutting wall abutting the reset member. A second inserting hole for inserting the pushing rod is opened on the third abutting wall. The reset member with both ends abutting the second and third abutting walls respectively is sleeved on the pushing rod.

In the self-service device for taking tableware according to one embodiment of the present application, the magazine is fixedly installed inside the housing body. The guide grooves at both sides of the magazine are provided with a second fine adjustment structure for adapting the guide grooves with the tableware size. A hollow cavity is mounted at the lower end of the guide groove, inside which hollow cavity, the first bearing block, the second bearing block and the third bearing block are mounted. An end wall at one end of the hollow cavity is the third abutting wall. The hollow cavity is provided with an upper opening and a lower opening. A clearance space is formed between the first bearing block and a lower end of the guide groove which is inserted into the tail end of the handle of the tableware to insert the pushing member for pushing the tableware in the bottommost layer. The clearance space is mutually corresponding with the tail end of the handle of the tableware in the bottommost layer. A movement space for a displacement of the food taking part of the tableware in the bottommost layer is formed along a longitudinal direction between the lower end of the guide groove which is inserted into the head end of the food taking part of the tableware and the second and third bearing blocks.

In the self-service device for taking tableware according to one embodiment of the present application, the stopping plate of the stopper is located at a position where the handle of the tableware stays after sliding along the inclined chute. A rotating structure is provided on one side of the stopping plate facing the inclined chute for preventing the tableware from returning during its pulling out. The rotating structure comprises a rotatable holding member for holding the food taking part of the tableware and an inserting hole for passing through the handle of the tableware. The rotatable holding member only rotates toward a direction of the stopping plate and resets along the way it comes. A block for preventing the rotatable holding member from rotating in a direction deviating from the stopping plate is arranged on one side of the rotatable holding member deviating from the stopping plate.

In the self-service utensil fetcher of the invention, a lower surface of the pushing portion of the pushing member is provided with a receiving member for receiving the handle of the tableware which is displaced. The receiving member and the pushing member move synchronously with respect to the first bearing block. One end of the receiving member is connected with the lower surface of the pushing portion via a connecting piece. The other end of the receiving member is a receiving portion formed by projecting relative to an end portion of the pushing portion. A movement space for a displacement relative to the first bearing block is formed between the lower surface of the pushing portion and an upper surface of the receiving member.

In the self-service device for taking tableware according to one embodiment of the present application, a penetrating hole is provided on the first bearing block for passing through the receiving member, the receiving portion of the receiving member is inserted into the penetrating hole, and the pushing portion moves along the upper surface of the first bearing block, while the receiving member moves along a hole wall of the penetrating hole during the movement.

In the self-service device for taking tableware according to one embodiment of the present application, the receiving member is located at a lower surface of the first bearing block, and the pushing portion moves along the upper surface of the first bearing block, while the receiving member moves along the lower surface of the first bearing block during the movement.

In the self-service device for taking tableware according to one embodiment of the present application, a prompter for indicating whether the tableware is about to be used up is installed at a side end of the magazine.

In the self-service device for taking tableware according to one embodiment of the present application, the prompter comprises a rotating member which automatically rebounds after rotation and is provided with a pressing handle formed by protruding upward from the rotating member for rotating by pressing the stacked tableware. The rotating member is provided with a first indication layer for indicating that the tableware is sufficient and a second indication layer for indicating that the tableware is about to be used up at its outer circumferential surface. The rotating member is mounted in a frame body, whose outer side is arranged with a display port for displaying the first indication layer and the second indication layer. The first indication layer is displayed by rotating the display port via pressing its pressing handle through the stacked tableware, while the second indication layer is displayed by an automatic rebound of the pressing handle.

In the self-service device for taking tableware according to one embodiment of the present application, one end of the first indication layer is connected with one end of the second indication layer.

In the self-service device for taking tableware according to one embodiment of the present application, the housing body is mounted with at least one sliding body on which the magazine, the support assembly, the inclined chute, the pushing member and the stopper are formed on each sliding body. Moreover, a bottom end of each sliding body is slidably connected with the housing body via a sliding mechanism.

In the self-service device for taking tableware according to one embodiment of the present application, the sliding mechanism comprises a guide rail formed at a bottom side of the housing body and a sliding groove formed at the bottom end of the sliding body. At least one pulley is installed on both sides of the guide rail, and moves along the sliding groove.

In the self-service device for taking tableware according to one embodiment of the present application, a stopping blocking member is provided for preventing the tableware from turning around is arranged above the inclined chute.

By the implementation of the self-service device for taking tableware according to the present application, several advantages can be obtained. The self-service device for taking tableware according to the present application has a neat appearance, and can be operated and taken out in a hermetically sealed environment, so the tableware is clean and hygienic. Furthermore, just one piece of tableware can be taken out for one time, and the receiving and taking out of the tableware is very portable and quick, thus the usage of the self-service device for taking tableware is economical and environmental protected.

BRIEF DESCRIPTION OF THE DRAWINGS

The present application is further illustrated combining the embodiments and drawings attached.

DETAILED DESCRIPTION OF THE PREFERRED EMBODIMENT

Figure 1:
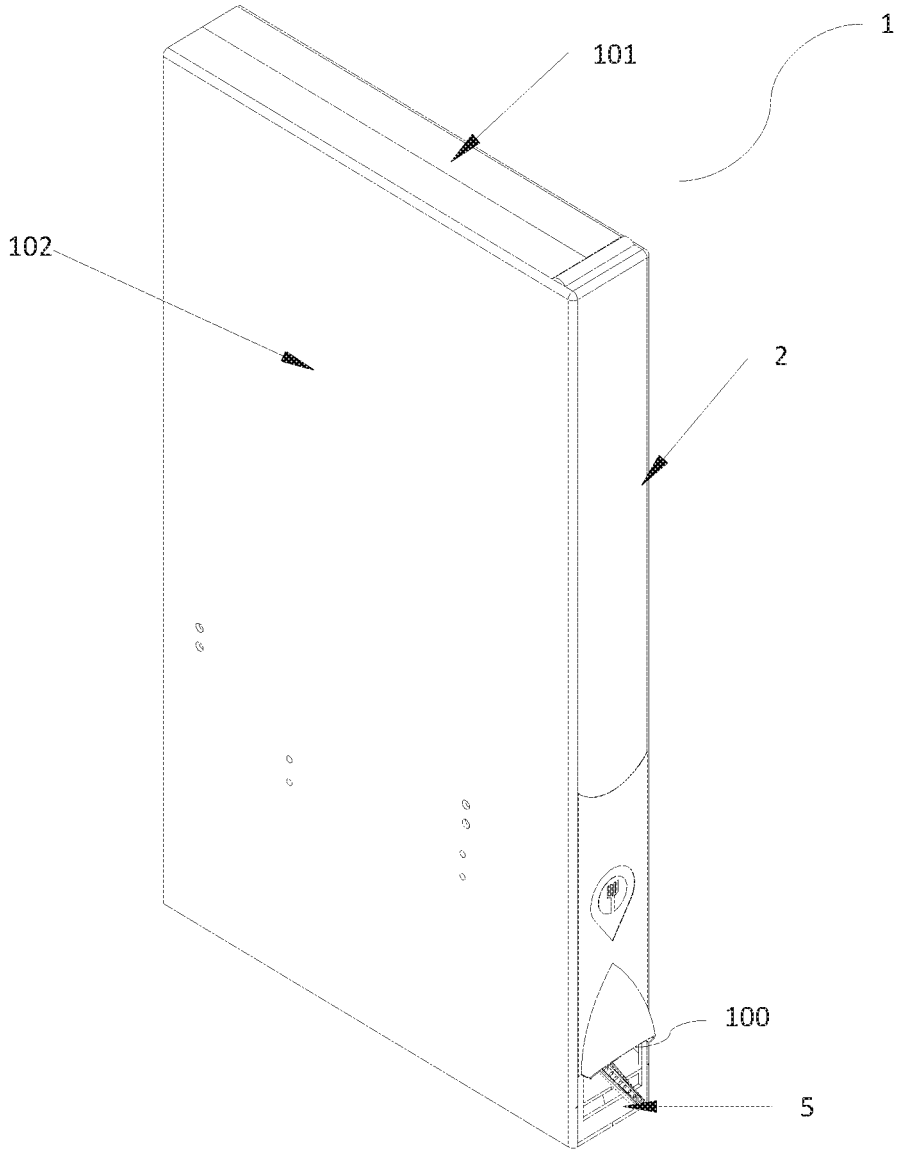
FIG. 1 is an external diagram of the self-service device for taking tableware according to the present application.

The structure and operation principle of the self-service device for taking tableware according to the present application are further illustrated with reference to the accompanying drawings and embodiments.

In the description of the present application, it is to be understood that the terms "center", "longitudinal", "transverse", "up", "down", "front", "back", "left", "right", "vertical", "horizontal", "top", "bottom", "inside", "outside", "clockwise", "counterclockwise", and the like, indicate the orientation or positional relationship shown in the drawings. It should be noted that such orientation or positional relationship is just for convenience of description of the present application and simplification of the description, rather than indicate or imply that the pointed device or member must have such certain orientation, must be constructed and operated in a specific orientation. Therefore, such terms should not be understood as a limitation of the present application.

As shown in FIG. 1-8, the present application relates to a self-service device for taking tableware which comprising a housing body 1 in which a magazine 3 for accommodating a plurality of tableware 5 is arranged. A support assembly 678 for supporting the plurality of tableware 5 is arranged under the magazine 3. The plurality of tableware 5 are sequentially stacked on the support assembly 678. Furthermore, a pushing member 9 is arranged at a side of the support assembly 678 for pushing the tableware 5 in a bottommost layer to displace relative the support assembly 678 for falling. The pushing member 9 is further provided with a reset member 12 for resetting itself after its pushing. Moreover, an inclined chute 19 is arranged in the housing body 1 for receiving the tableware 5 falling from the support assembly 678 and guiding the same to slide out. In an embodiment of the present application, the tableware 5 can be a fork, a spoon, and other types of tableware. The reset member 12 can be a spring or a resilient trip and so on.

Embodiment 1

Figure 2:
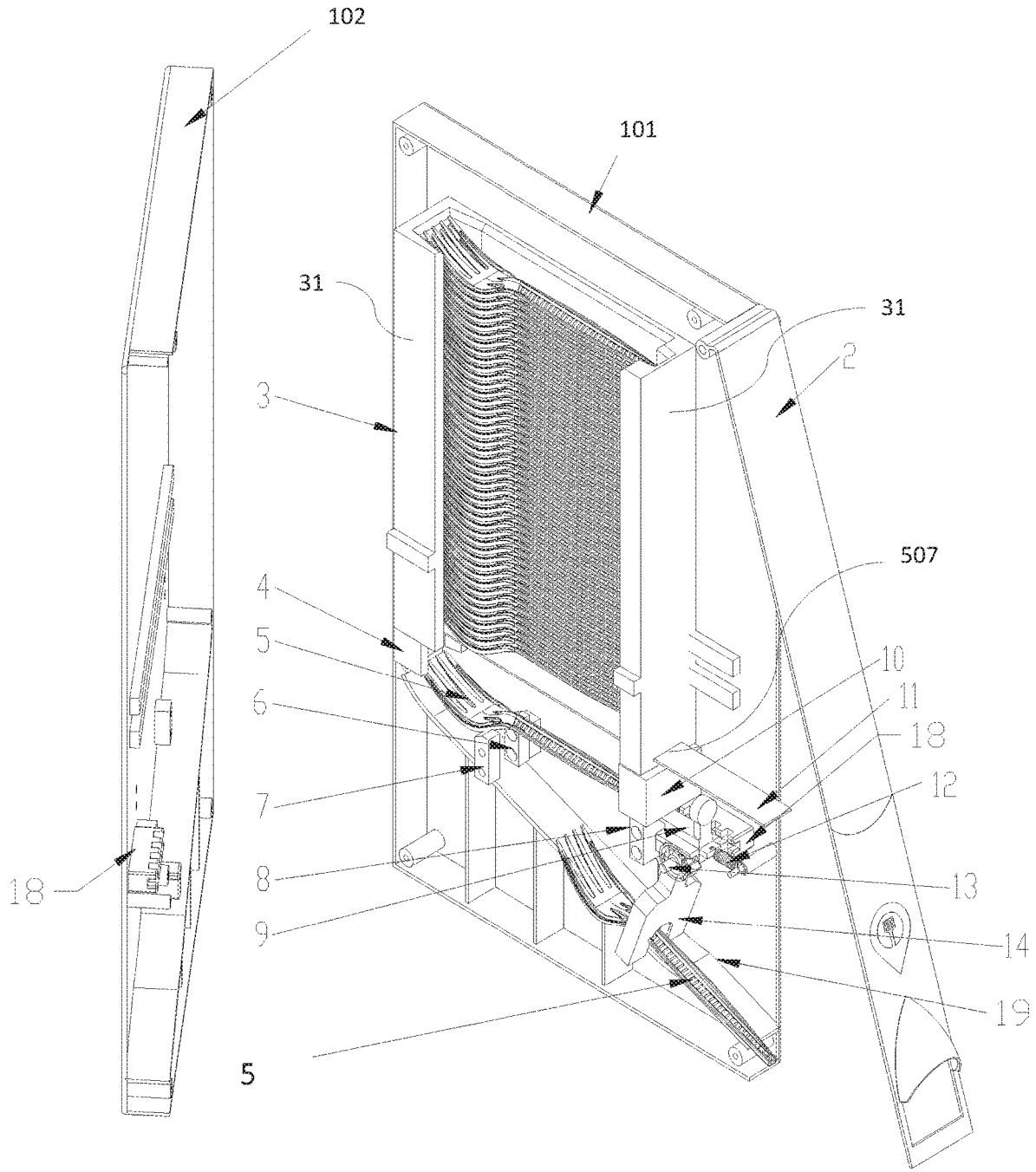
FIG. 2 is a structure diagram of the self-service device for taking tableware according to a first embodiment of the present application, in which the housing body is removed.

As shown in FIGS. 1-2, the housing body 1 comprises a first shell body 101, a second shell body 102 and a reversible clamshell cover 2 arranged at the side end. A tableware takeout outlet 100 is opened on the clamshell cover 2 for taking out the tableware 5. A transparent window and a lock button are further arranged on the reversible clamshell cover 2 for storage and clean management of the tableware 5. The housing body 1 can also be made of plastic or metal.

Figure 3:
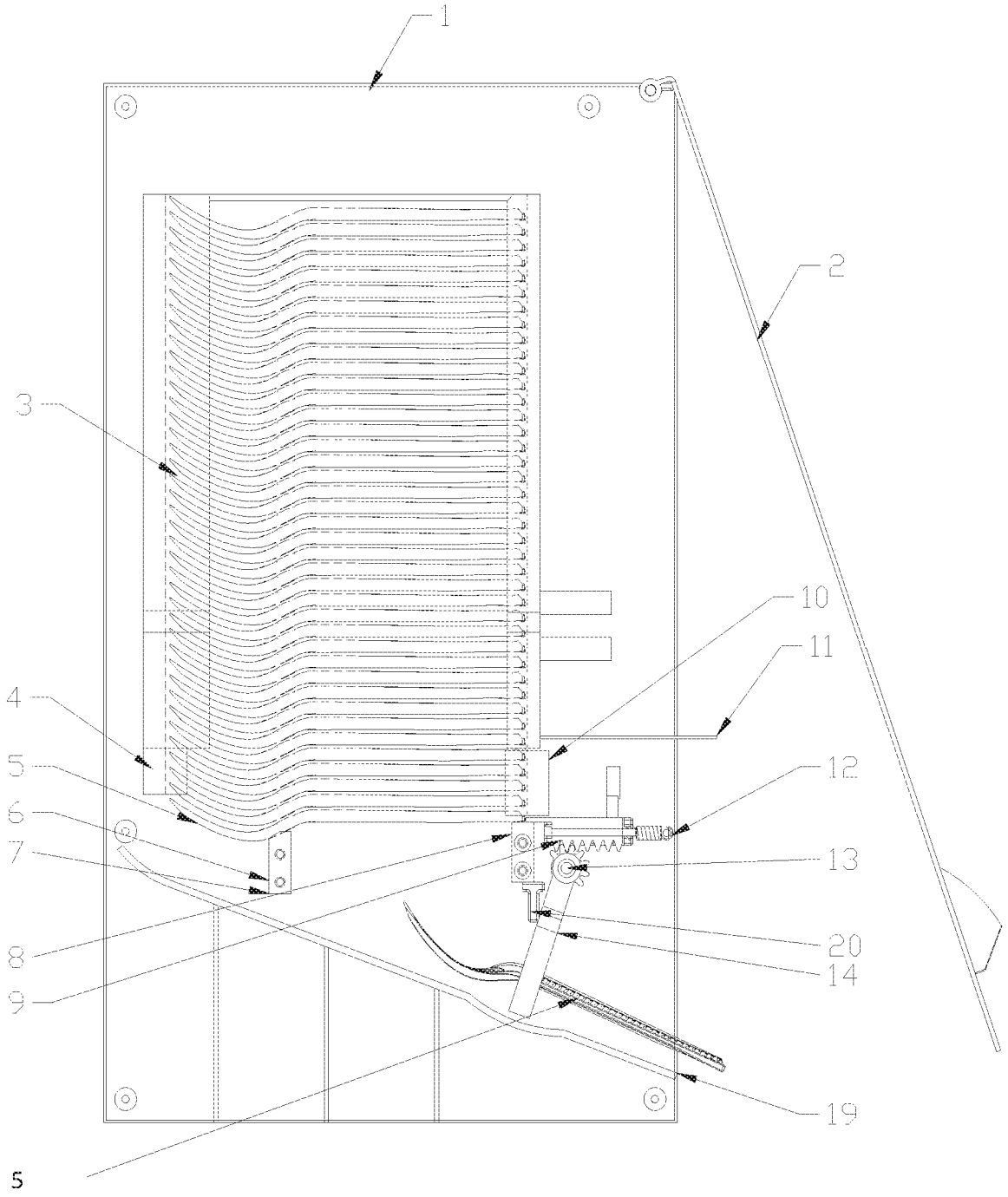
FIG. 3 is a front view of the structures of the self-service device for taking tableware according to the first embodiment of the present application, which structures are located inside the housing body.

As shown in FIGS. 2-3, guide grooves 31 are respectively arranged at both sides of the magazine 3 and the tableware 5 is sequentially stacked along the guide grooves 31. A detachment plate 11 used for sending the stacked tableware 5 into the magazine 3 and then being detached is mounted at the bottom of the magazine 3, while a detachment hole 507 for detaching the detachment plate 11 is opened on the guide groove 31 of the magazine 3. The magazine 3 is detachably mounted in the housing body 1. The magazines 3 of different specifications can be arranged for adapting the uses of the tableware 5 of different specifications. When using, the plurality of tableware 5 are stacked on the detachment plate 11 along the guide groove 31, and then the clamshell cover 2 is opened for sending the same into the housing body 1. After the magazine 3 has been placed, the detachment plate 11 is detached.

As shown in FIGS. 2-5, the support assembly 678 comprises a first bearing block 8 for supporting a tail end of the handle **5*b* of the tableware 5, a second bearing block 6 and a third bearing block 7 for supporting both sides of the food taking part 5*a* of the tableware 5. The second bearing block 6 and third bearing block 7 are respectively arranged in parallel at both sides under the food taking part 5*a* of the tableware 5 in the bottommost layer, while the first bearing block 8 is arranged under the tail end of the handle 5*b* of the tableware 5 in the bottommost layer. When the detachment plate 11 is detached, the stacked tableware 5 would fall onto the first bearing block 8, the second bearing block 6 and the third bearing block 7**.

Figure 4:
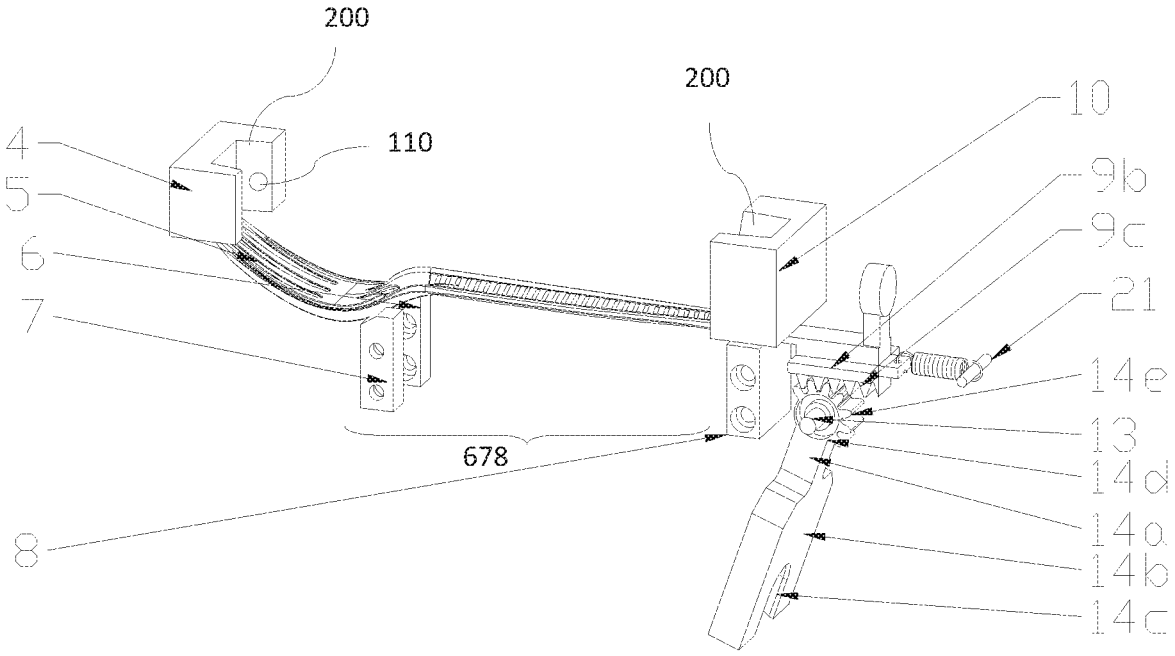
FIG. 4 is a diagram of the partial structure of the self-service device for taking tableware according to the first embodiment of the present application.
Figure 5:
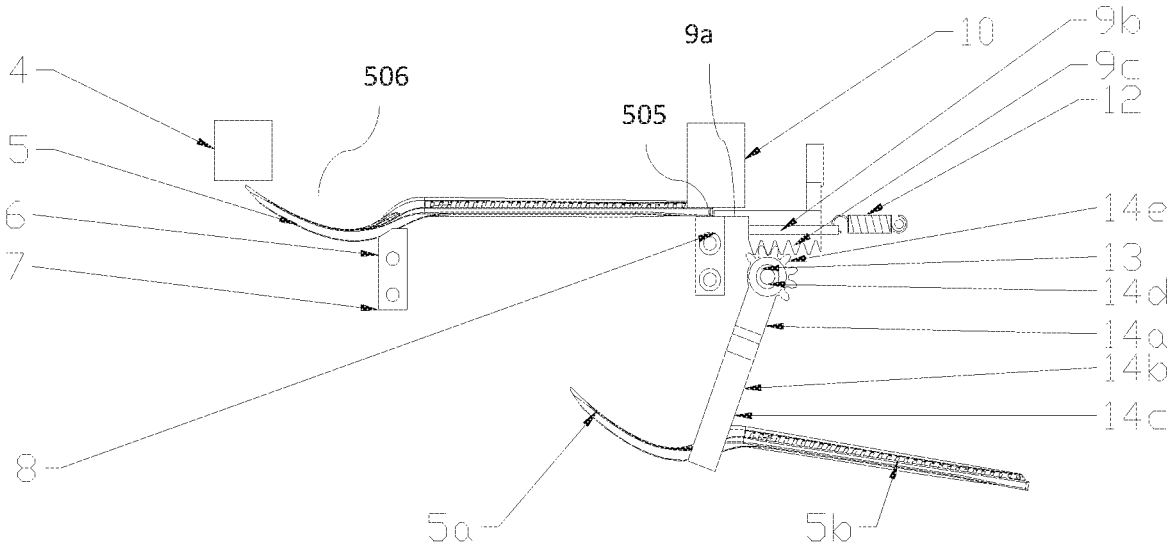
FIG. 5 is a front view of the partial structure of the self-service device for taking tableware according to the first embodiment of the present application.

As shown in FIGS. 4 and 5, a first adjusting and stopping block 10 is arranged at the lower end of the guide groove 31 which is inserted into the tail end of the handle **5*b* of the tableware 5. The first bearing block 8 is located below the first adjusting and stopping block 10 and a clearance space 505 is formed between the first bearing block 8 and the first adjusting and stopping block 10 to insert the pushing member 9 for pushing the tableware 5 in the bottommost layer. The clearance space 505 is mutually corresponding with the tail end of the handle 5*b* of the tableware 5 in the bottommost layer. A second adjusting and stopping block 4 is arranged at the lower end of the guide groove 31 which is inserted into a heat end of the food taking part 5*a* of the inserted tableware 5. A movement space 506 for a displacement of the food taking part 5*a* of the tableware 5 in the bottommost layer is formed along a longitudinal direction between the second adjusting and stopping block 4 and the second bearing block 6 and the third bearing block 7. Via such design, the pushing member 9 is inserted into the clearance space 505 to push the tableware 5 in the bottommost layer to move forward, thus the tableware 5 would fall from the first bearing block 8, the second bearing block 6 and the third bearing block 7 onto the inclined chute 19. Wherein the first adjusting and stopping block 10 and the second adjusting and stopping block 4 are used for stopping the tableware which is stacked above the tableware 5 in the bottommost layer, so as to avoid that the tableware stacked above moves with the displacement of the tableware 5 in the bottommost layer. Just the tableware 5 in the bottommost layer can be displaced by the arrangement of the first adjusting and stopping block 10 and the second adjusting and stopping block 4**.

The first adjusting and stopping block 10 and the second adjusting and stopping block 4 are both provided with a first fine adjustment structure 110 for adapting the clearance space 505 and the movement space 506 with the tableware size. The first fine adjustment structure 110 can be a plurality of mounting holes opened on the first adjusting and stopping block 10 and the second adjusting and stopping block 4 for mounting the fastener. The fastener can be arranged in different mounting holes for adjusting the position. The first fine adjustment structure 110 can also be a fastener mounted on the first adjusting and stopping block 10 and the second adjusting and stopping block 4. Meanwhile, a plurality of mounting holes can be opened on the housing body 1 for adjusting the positions of the first adjusting and stopping block 10 and the second adjusting and stopping block 4 for adapting the tableware of different sizes. Of course, the fastener can also be the screw and so on.

It should be noted that, after being sent into the housing body 1, the magazine 3 is placed on the first adjusting and stopping block 10 and the second adjusting and stopping block 4. The two guide grooves 31 are connected with the first adjusting and stopping block 10 and the second adjusting and stopping block 4, respectively. Furthermore, the first adjusting and stopping block 10 and the second adjusting and stopping block 4 are provided with two grooves 200 communicating with the two guide grooves 31.

As shown in FIGS. 4-5, a pushing portion 9*a* for pushing the tableware 5 in a bottommost layer is formed on one end of the pushing member 9, while the reset member 12 is connected at the other end of the pushing member 9 far away from the pushing portion 9*a*. The other end of the reset member 12 is fixed via the shaft pin 21. In the present embodiment, the reset member 12 can be a spring. However, in the other embodiment, the reset member 12 can also be a resilient trip. Sliding portions 9*b* are formed at both sides of the pushing member 9 and a guiding chute 18 adapting to the end of each sliding portion 9*b* is formed on the first shell body 10*l* and the second shell body 102 of the housing body 1.

Figure 6:
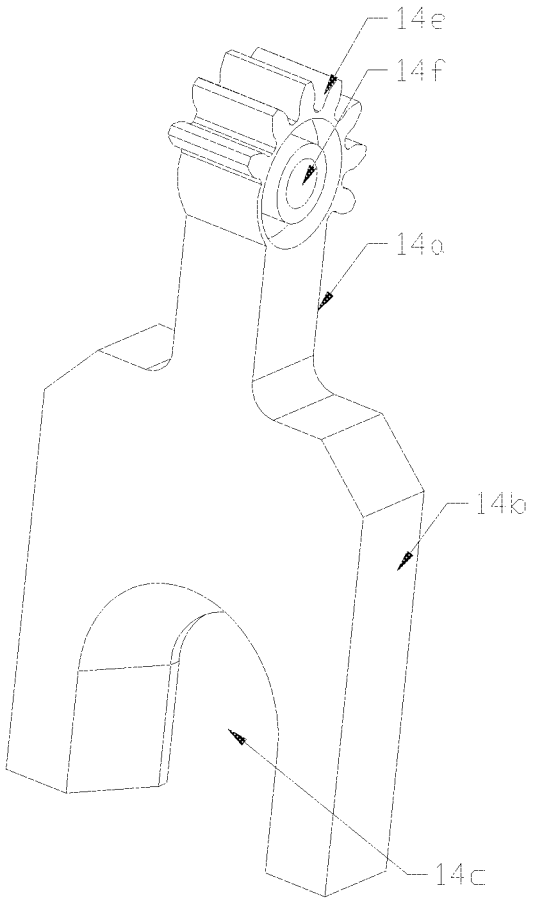
FIG. 6 is a structure diagram of the stopper of the self-service device for taking tableware according to the first embodiment of the present application.

As shown in FIGS. 2-5, the pushing member 9 is further provided with a stopper 14 for taking out the tableware 5 falling onto the inclined chute 19 by operating in linkage with the pushing member 9. As shown in FIGS. 5-6, the stopper 14 comprises a swinging rod 14*a* swinging with the taking out of the tableware 5. One end of the swinging rod 14*a* is connected with a stopping plate 14*b* for holding a food taking part 5*a* of the tableware 5 during the taking out of the tableware 5 and on which stopping plate 14*b*, a recess hole 14*c* is provided for passing through a handle 5*b* of the tableware 5. The other end of the swinging rod 14*a* far away from the stopping plate 14*b* is connected with a linkage portion 14*d* linked with the pushing member 9. The recess hole 14*c* has a size smaller than that of the food taking part 5*a* of the tableware 5, but bigger than that of the handle 5*b* of the tableware 5. In the present embodiment, the swinging rod 14*a*, the stopping plate 14*b* and the linkage portion 14*d* are formed in one-piece. In the other embodiment, the swinging rod 14*a*, the stopping plate 14*b* and the linkage portion 14*d* are not formed in one-piece. Instead, they can be formed separately and then be connected by screws and so on.

As shown in FIGS. 4-6, in the present embodiment, a shaft hole 14*f* is opened on the linkage portion 14*d* which is mounted on a fixed shaft 13 through the shaft hole 14*f*. The linkage portion 14*d* is provided with a gear structure 14*e* formed on its outer periphery, while the pushing member 9 is provided with a chain structure 9*c* meshing with the gear structure 14*e* which specifically is a gear of a half cycle. Via the gear structure 14*e* and the chain structure 9*c*, the pushing member 9 is brought to move by the stopper 14 and the stopper 14 is reset by the reset of the pushing member 9. To be specific, one sliding portion 9*b* of the pushing member 9 has a structure corresponding to the gear structure 14*e* of the stopper 14, and the chain structure 9*c* is formed at the lower end of the sliding portion 9*b* corresponding to the gear structure 14*e* of the stopper 14.

As shown in FIG. 3, a stopping block 20 is arranged below the first bearing block 8 for avoiding the excessive swing of the stopper 14 during its resetting.

Via above design, the stopper 14 would be brought to rotate when the tableware is taken out. Along with the rotation of the gear structure 14*e*, the chain structure 9*c* of the pushing member 9 moves, such that the pushing portion 9*a* of the pushing member 9 pushes the tableware 5 in the bottommost layer in the clearance space 505 to displace and fall into the inclined chute 19 arranged below. Then the tableware 5 in the bottommost layer slides to the tableware takeout outlet 100. Meanwhile, the reset member 12 would reset the pushing member 9. During the reset process, the chain structure 9*c* on the pushing member 9 would bring the gear structure 14*e* to rotate, thus reset the stopper 14 back to a static state. The new fallen tableware 5 would stop sliding when it reaches the stopper 14, such that the new fallen tableware 5 would be limited to the tableware takeout outlet 100. In such a way, a next automatic taking out cycle is prepared.

Embodiment 2

Figure 7:
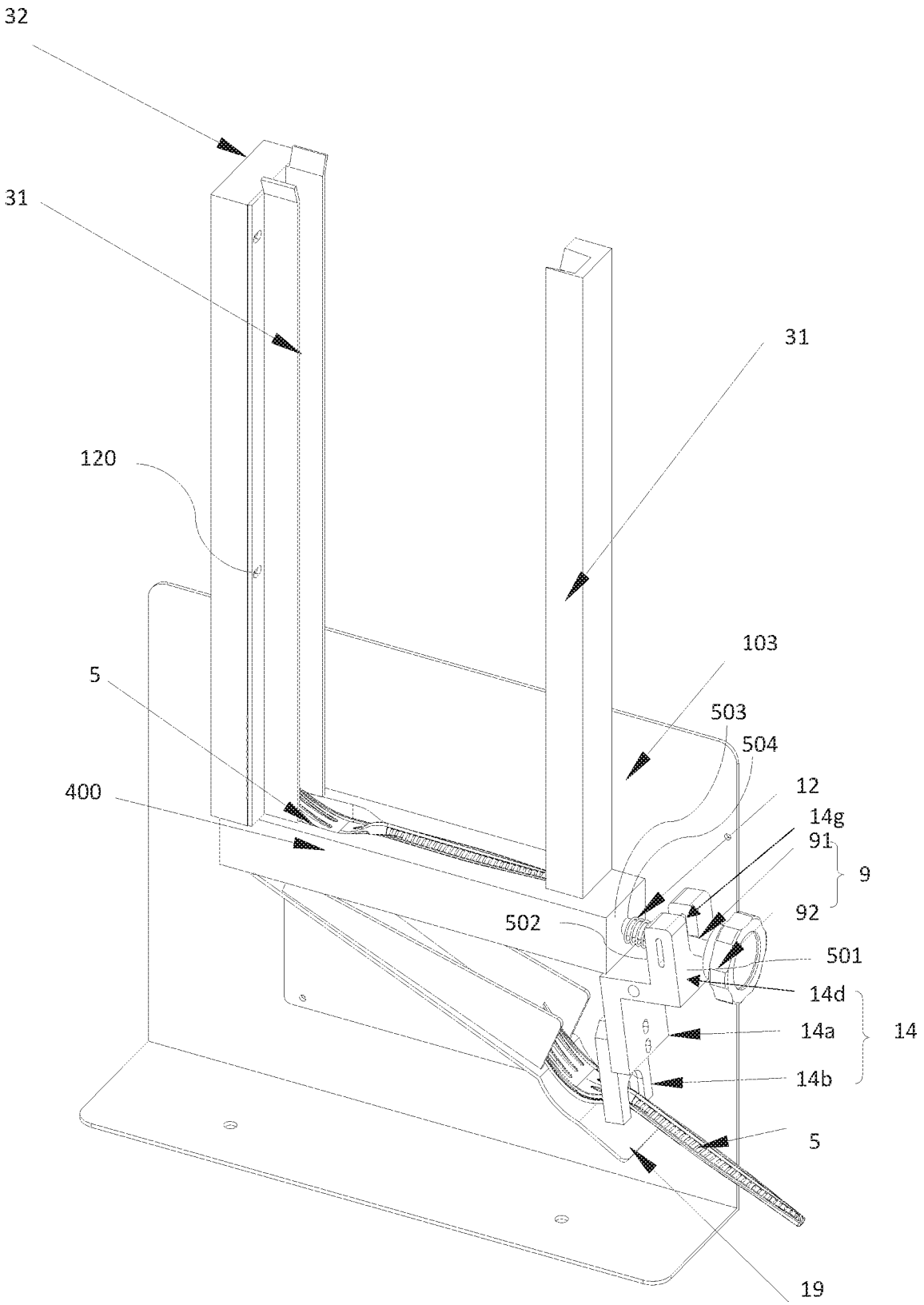
FIG. 7 is a structure diagram of the structures of the self-service device for taking tableware according to a second embodiment of the present application, which structures are located inside the housing body.
Figure 8:
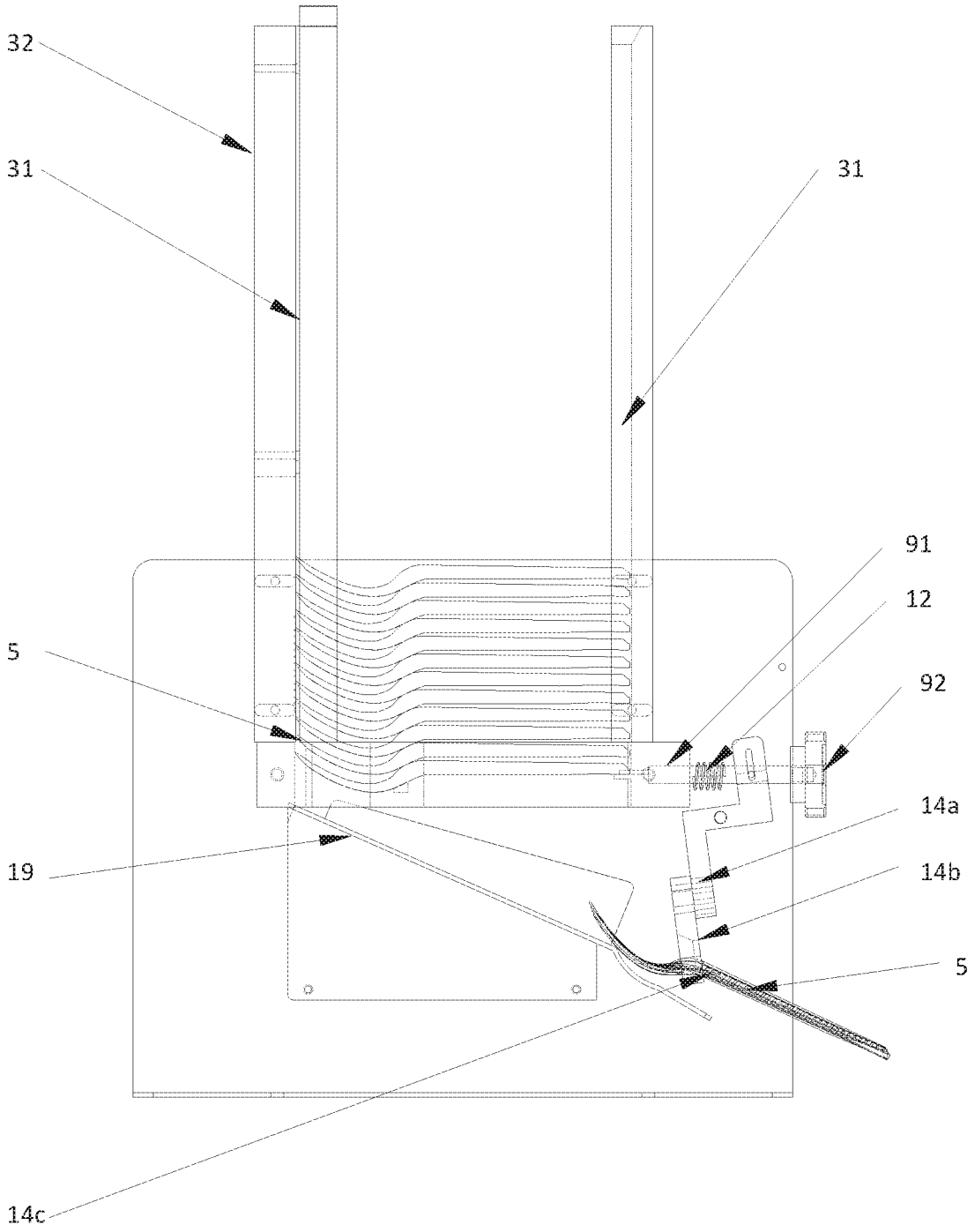
FIG. 8 is a front view of the structures of the self-service device for taking tableware according to the second embodiment of the present application, which structures are located inside the housing body.

The present embodiment is different from the embodiment 1 in follows. As shown in FIGS. 7-8, a mounting plate 103 is fixedly mounted on the housing body 1. The guide grooves 31 at both sides of the magazine 3 are provided with a second fine adjustment structure 120 for adapting the guide grooves 31 with the tableware size. The second fine adjustment structure 120 can be a plurality of mounting holes opened on the guide grooves 31 for mounting the fastener, the position adjustment can be implemented via those mounting holes. The second fine adjustment structure 120 can also be a fastener mounted on the guide grooves 31. Meanwhile, a plurality of mounting holes can be opened on the mounting plate 103 for adjusting the positions of the two guide grooves 31 for adapting the tableware of different sizes. An adjusting block 32 is arranged on one of the guide grooves 31 for adjusting its position.

A hollow cavity 400 is mounted at the lower end of the magazine 3, inside which the first bearing block 8, the second bearing block 6 and the third bearing block 7 are mounted.

The hollow cavity 400 is provided with an upper opening and a lower opening. A clearance space 505 is formed between the first bearing block 8 and a lower end of the guide groove 31 which is inserted into the tail end of the handle 5*b* of the tableware 5 to insert the pushing member 9 for pushing the tableware 5 in the bottommost layer. The clearance space 505 is mutually corresponding with the tail end of the handle 5*b* of the tableware 5 in the bottommost layer. A movement space 506 for a displacement of the food taking part 5*a* of the tableware 5 in the bottommost layer is formed along a longitudinal direction between the lower end of the guide groove 31 which is inserted into the head end of the handle 5*b* of the tableware 5 and the second bearing block 6 and the third bearing block 7. That is, in the present embodiment, the first adjusting and stopping block 10 and the second adjusting and stopping block 4 shown in the first embodiment are not arranged.

The pushing member 9 comprises a pushing rod 91 having one end for pushing the tableware 5 in a bottommost layer, and the other end far away from the tableware 5 in a bottommost layer connected with a pushing button 92. A first inserting hole 14*g* for inserting the pushing rod 91 is formed on the linkage portion 14*d* of the stopper 14, wherein, the first inserting hole 14*g* has a size which is larger than that of the pushing rod 91 along the radial direction, but smaller than that of the reset member 12 and that of the pushing button 92. Meanwhile, the reset member 12 also can be a spring or a resilient trip. A first abutting wall 501 for abutting the pushing button 92 is provided at one side of the linkage portion 14*d* facing the pushing button 92, and a second abutting wall 502 for abutting the reset member 12 is provided at the other side of the linkage portion 14*d* away from the pushing button 92. The magazine 3 is provided with a third abutting wall 503 abutting the reset member 12. A second inserting hole 504 for inserting the pushing rod 91 is opened on the third abutting wall 503. The reset member 12 with both ends abutting the second abutting wall 502 and third abutting wall 503 respectively is sleeved on the pushing rod 91. In the present embodiment, the third abutting wall 503 is the end wall of one end of the hollow cavity 400.

In the present embodiment, a stopping block which is arranged as the hollow cavity 400, is disposed below the first bearing block 8 for avoiding the excessive swing of the stopper 14 during its resetting as well. In the present embodiment, the swinging rod 14*a* and the linkage portion 14*d* of the stopper 14 are formed in one piece structure having a Z-shape with a 90° rotation. The connection portion between the swinging rod 14*a* and the linkage portion 14*d* matches with the stopping block for preventing it from excessive rotation. The stopping plate 14*b* is connected with the swinging rod 14*a* via screws and so on.

Via above design, the stopper 14 would be brought to swing by pressing the pushing button 92 of the pushing member 9 for letting the last tableware 5 trapped by the stopper 14 to slide out for facilitating the user to take it out. Meanwhile, the pushing rod 91 of the pushing member 9 pulls the tableware 5 in the bottommost layer to displace and fall onto the inclined chute 19 arranged below. Then the fallen tableware 5 in the bottommost layer slides to the tableware takeout outlet 100 and is trapped by the stopper 14. In such a way, a next automatic taking out cycle is prepared.

It should be noted that, in the embodiment 2, the detachable magazine 3 in the embodiment 1 also can be employed. Meanwhile, the first adjusting and stopping block 10 and the second adjusting and stopping block 4 in embodiment 1 also can be mounted in the embodiment 2. In additional, the fixedly mounted magazine 3 in the embodiment 2 also can be employed in the embodiment 1.

Embodiment 3

Figure 9:
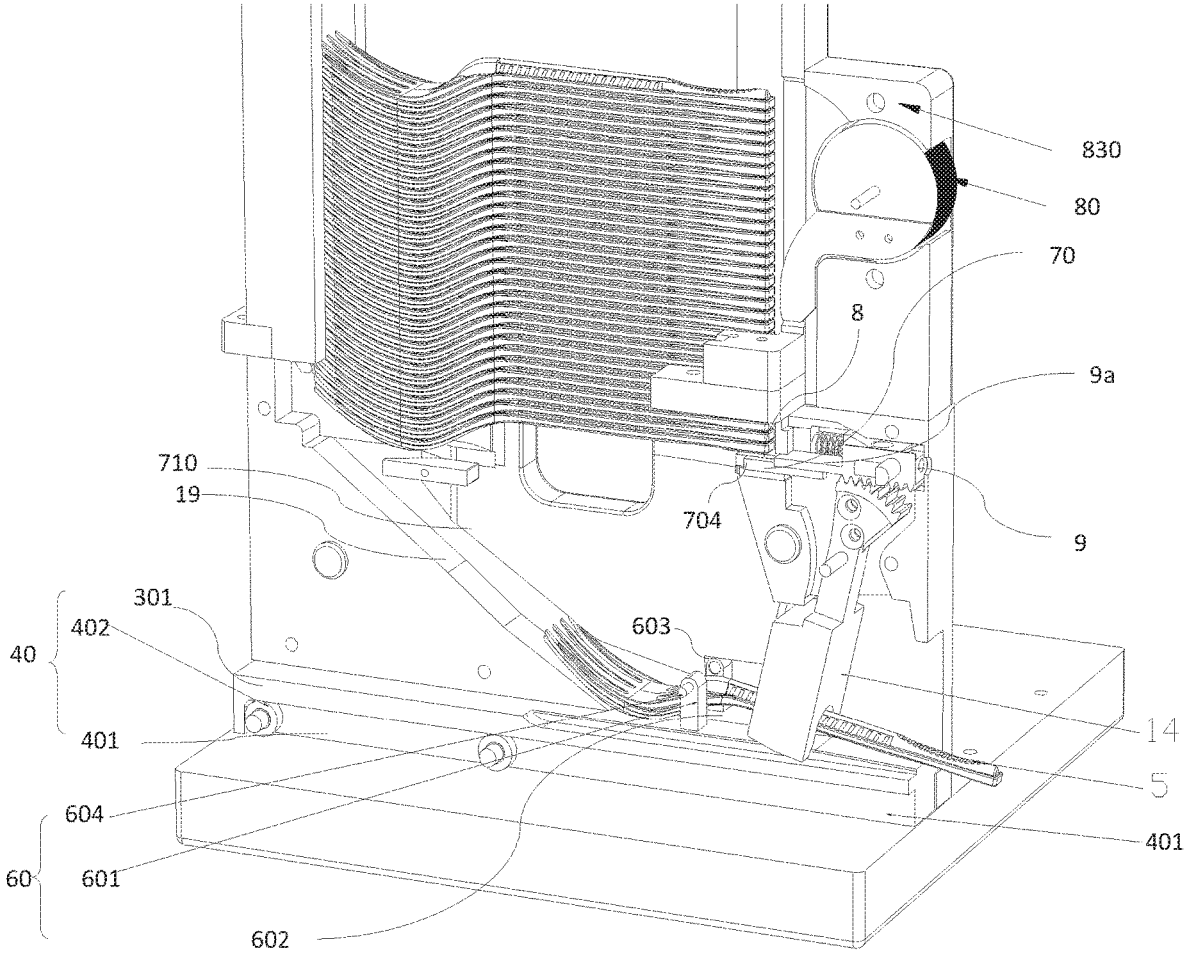
FIG. 9 is a diagram of the inner structure of the self-service device for taking tablewai according to the preferable embodiments of the preset application.

The present embodiment is different from the embodiment 1 or 2 in follows. As shown in FIG. 9, the stopping plate 14*b* of the stopper 14 is located at a position where the handle 5*b* of the tableware 5 stays after sliding along the inclined chute 19, that is, being approximately close to the tail end of the inclined chute 19 arranged below. A rotating structure 60 is provided on one side of the stopping plate 14*b* facing the inclined chute 19 for preventing the tableware 5 from returning during its pulling out. The rotating structure 60 can be arranged at the tail end of the inclined chute 19 arranged below or between the tail end of the inclined chute 19 arranged below and the stopping plate 14*b* of the stopper 14.

The rotating structure 60 comprises a rotatable holding member 601 for holding the food taking part 5*a* of the tableware 5 and an inserting hole 602 for passing through the handle 5*b* of the tableware 5. The rotatable holding member 601 only rotates toward a direction of the stopping plate 14*b* and resets along the way it comes. A block 603 for preventing the rotatable holding member 601 from rotating in a direction deviating from the stopping plate 14*b* is arranged on one side of the rotatable holding member 601 deviating from the stopping plate 14*b*.

In this embodiment, there are two rotatable holding members 601 arranged separately at opposite directions for forming the inserting hole 602. The two rotatable holding members 601 are rotatably arranged via the rotation shaft 604 respectively. In other embodiments, there can be only one rotatable holding member 601 with the inserting hole 602 opened therewith and the rotatable holding member 601 can also be rotatably arranged via the rotation shaft 604.

In the process of taking the tableware 5 out, the stopper 14 would bring the pushing member 9 to move, so as to push the tableware 5 in the bottommost layer to fall off, there is a possibility that the tableware 5 is not completely removed, and the user will push the tableware 5 back toward the inclined chute 19. Then, in the process of taking the tableware 5 out again, the tableware 5 may fall again, which results in the falling of a plurality of tableware 5. However, in the present application, such situation can be avoided by designing a rotating mechanism 60 that rotates only in the direction facing the stopper 14.

Embodiment 4

Figure 10:
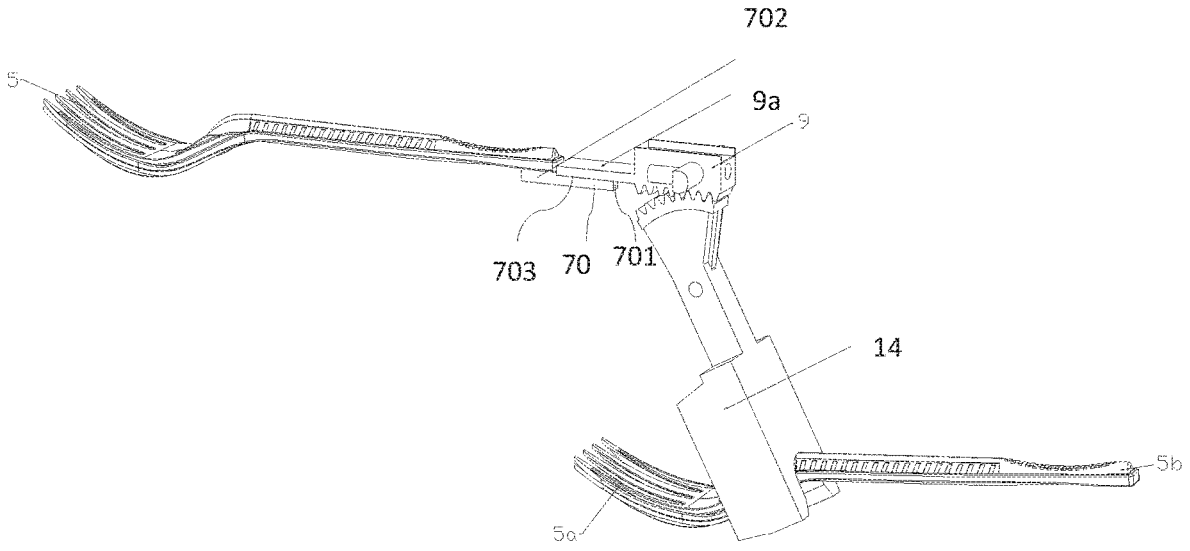
FIG. 10 is a diagram of the partial structure of the self-service device for taking tableware according to the fourth embodiment of the present application.

The present embodiment is different from the embodiment 1, 2 or 3 in follows. As shown in FIGS. 9-10, a lower surface of the pushing portion 9*a* of the pushing member 9 is provided with a receiving member 70 for receiving the handle 5*b* of the tableware 5 which is displaced. The receiving member 70 and the pushing member 9 move synchronously with respect to the first bearing block 8. One end of the receiving member 70 is connected with the lower surface of the pushing portion 9*a* via a connecting piece 701. The other end of the receiving member 70 is a receiving portion 702 formed by projecting relative to an end portion of the pushing portion 9*a*. A movement space 703 for a displacement relative to the first bearing block 8 is formed between the lower surface of the pushing portion 9*a* and an upper surface of the receiving member 70.

In the present embodiment of the present application, a penetrating hole 704 is provided on the first bearing block 8 for passing through the receiving member 70, while the receiving portion 702 of the receiving member 70 is inserted into the penetrating hole 704. Accordingly, the pushing portion 9*a* moves along the upper surface of the first bearing block 8, while the receiving member 70 moves along a hole wall of the penetrating hole 704 during the movement.

In the other embodiment, the receiving member 70 is located at a lower surface of the first bearing block 8, and the clearance space between the lower surface of the pushing portion 9*a* and the upper surface of the receiving member 70 along the longitudinal direction approximately matches the thickness of the first bearing block 8. The pushing portion 9*a* moves along the upper surface of the first bearing block 8, while the receiving member 70 moves along the lower surface of the first bearing block 8.

After bringing the pushing member 9 to pushing the tableware 5 in the bottommost layer to fall off by the stopper 14, the handle 5*b* of the tableware 5 would fall onto the receiving portion 702 of the receiving member 70, rather than fall off immediately. When the stopper 14 and the pushing member 9 are reset, the receiving member 70 would also be reset to withdraw back and then the tableware 5 falling onto the receiving portion 702 of the receiving member 70, would fall off really. In such a way, the situation of the falling of a plurality of tableware 5 would be avoided similarly.

Embodiment 5

Figure 11:
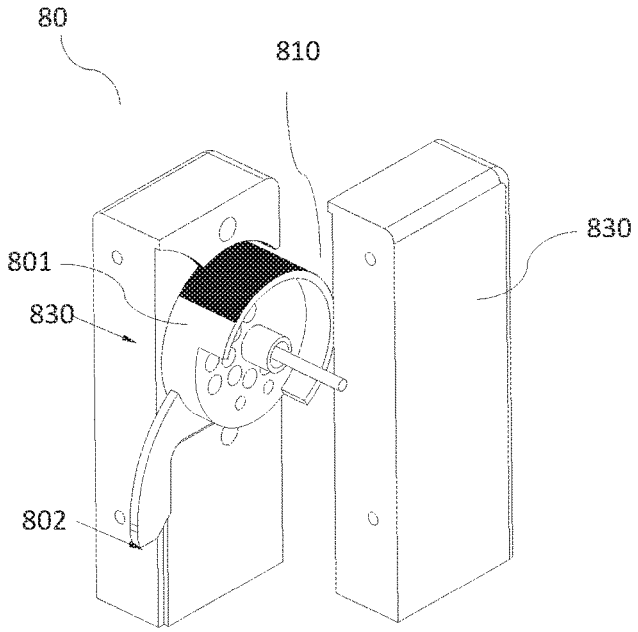
FIG. 11 is a state diagram of the prompter of the self-service device for taking tableware in the first state according to the fifth embodiment of the present application.
Figure 12:
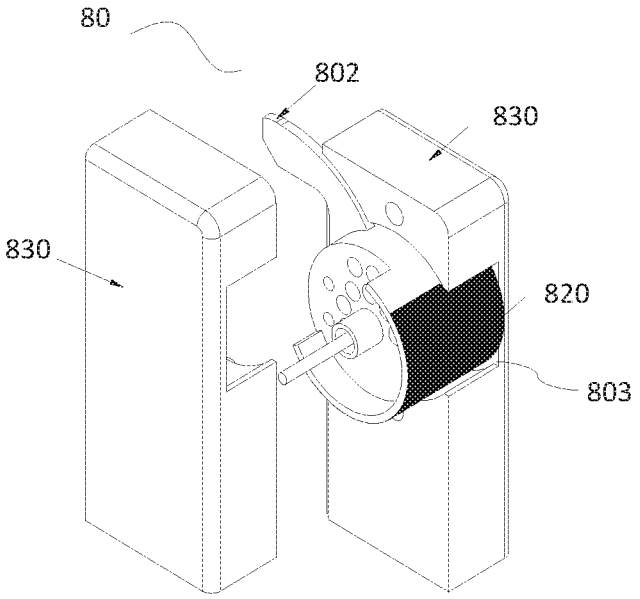
FIG. 12 is a state diagram of the prompter of the self-service device for taking tableware in the second state according to the fifth embodiment of the present application.

The present embodiment is different from the embodiment 1, 2, 3 or 4 in follows. As shown in FIGS. 9, 11 and 12, a prompter 80 for indicating whether the tableware 5 is about to be used up is installed at a side end of the magazine 3.

The prompter 80 comprises a rotating member 801 which automatically rebounds after rotation, such as through a torsion spring. The rotating member 801 is provided with a pressing handle 802 formed by protruding upward from the rotating member 801 for rotating by pressing the stacked tableware 5. The rotating member 801 is provided with a first indication layer 810 for indicating that the tableware 5 is sufficient and a second indication layer 820 for indicating that the tableware 5 is about to be used up at its outer circumferential surface. The rotating member 801 is mounted in a frame body 830, whose outer side is arranged with a display port 803 for displaying the first indication layer 810 and the second indication layer 820. The display port 803 can also be provided with a perspective window. The first indication layer 810 and the second indication layer 820 may be ink layers of different colors formed by coating or pattern layers formed by etching. In one embodiment of the present application, one end of the first indication layer 810 is connected with one end of the second indication layer 820. In another embodiment of the present application, there can be separated distance between the first indication layer 810 and the second indication layer 820.

As long as the pressing handle 802 is pressed to rotate through the stacked tableware 5, the first indication layer 810 is displayed by the display port 803. When the stacked tableware 5 is about to be used out, the pressing handle 802 would automatically rebound, such that the second indication layer 820 is displayed by the display port 803.

Whether the stacked tableware 5 is about to be used out can be shown by the prompter 80, such that the tableware 5 can be supplemented into the magazine 3 whenever necessary.

Embodiment 6

The present embodiment is different from the embodiment 1-5 in follows. As shown in FIG. 9, the housing body 1 is mounted with at least one sliding body 30 on which the magazine 3, the support assembly 678, the inclined chute 19, the pushing member 9 and the stopper 14 are formed on each sliding body 30. Moreover, a bottom end of each sliding body 30 is slidably connected with the housing body 1 via a sliding mechanism 40.

In the present embodiment of the present application, the sliding mechanism 40 comprises a guide rail 401 formed at a bottom side of the housing body 1 and a sliding groove 301 formed at the bottom end of the sliding body 30. At least one pulley 402 is installed on both sides of the guide rail 401, and moves along the sliding groove 301. There can be one or more pulley 402 on both sides of the guide rail 401, which depends on the actual requirements.

It should be noted that the sliding mechanism 40 shown in FIG. 9 is only schematic, as long as the sliding mechanism 40 can make the sliding body 30 sliding, it falls into within the protection scope of the present application.

Through the above design, the sliding body 30 can be freely slidden out and installed to supplement the new tableware 5 or for maintaining.

Embodiment 7

The present embodiment is different from the embodiment 1-6 in follows. As shown in FIG. 9, a stopping blocking member 710 provided for preventing the tableware 5 from turning around is arranged above the inclined chute 19. Through this design, the turning of the tableware 5, especially the knife in the inclined chute 19 is avoided. The food taking part 5*a* of the tableware 5 may not be hold by the stopping plate 14*b* of the stopper 14, but passes through the recess hole 14*c* and/or the inserting hole 602 of the rotating structure 60, which results in that the tableware 5 in the magazine 3 may not fall off.

The self-service device for taking tableware according to the present application has a neat appearance, and can be operated and taken out in a hermetically sealed environment, so the tableware is clean and hygienic. Furthermore, just one piece of tableware can be taken out for one time, and the receiving and taking out of the tableware is very portable and quick, thus the usage of the self-service device for taking tableware is economical and environmental protected.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A self-service device for taking tableware comprising: a housing body (1) in which a magazine (3) for accommodating a plurality of tableware (5) is arranged, and a support assembly (678) for supporting the plurality of tableware (5) arranged under the magazine (3); wherein the plurality of tableware (5) is sequentially stacked on the support assembly (678); a pushing member (9) is arranged at a side of the support assembly (678) for pushing the tableware (5) in a bottommost layer to displace relative to the support assembly (678) for falling off; wherein the pushing member (9) is provided with a reset member (12) for resetting itself after its pushing; wherein an inclined chute (19) is arranged in the housing body (1) for receiving the tableware (5) falling from the support assembly (678) and guiding the same to slide out;

wherein the pushing member (9) is further provided with a stopper (14) for taking out the tableware (5) falling onto the inclined chute (19) by operating in linkage with the pushing member (9); wherein the stopper (14) comprises a swinging rod (14*a*) swinging with the taking out of the tableware (5), one end of the swinging rod (14*a*) is connected with a stopping plate (14*b*) for holding a food taking part (5*a*) of the tableware (5) during the taking out of the tableware (5) and on which stopping plate (14*b*), a recess hole (5*c*) is provided for passing through a handle (5*b*) of the tableware (5), the other end of the swinging rod (14*a*) far away from the stopping plate (14*b*) is connected with a linkage portion (14*d*) linked with the pushing member (9);

a shaft hole (14*f*) is opened on the linkage portion (14*d*), wherein the linkage portion (14*d*) is mounted on a fixed shaft (13) through the shaft hole (14*f*), the linkage portion (14*d*) is provided with a gear structure (14*e*) formed on its outer periphery, while the pushing member (9) is provided with a chain structure (9*c*) meshing with the gear structure (14*e*); wherein via the gear structure (14*e*) and the chain structure (9*c*), the pushing member (9) is brought to move by the stopper (14) and the stopper (14) is reset by a reset of the pushing member (9).

2. The self-service device for taking tableware according to claim 1, wherein a pushing portion (9*a*) for pushing the tableware (5) in a bottommost layer is formed on one end of the pushing member (9), while the reset member (12) is connected at the other end of the pushing member (9) far away from the pushing portion (9*a*); wherein sliding portions (9*b*) are formed at both sides of the pushing member (9), wherein one sliding portion (9*b*) has a structure corresponding to the gear structure (14*e*) of the stopper (14), and the chain structure (9*c*) is formed at a lower end of the sliding portion (9*b*) corresponding to the gear structure (14*e*) of the stopper (14); wherein a guiding chute (18) adapting to an end of each sliding portion (9*b*) is formed inside the housing body (1).

3. The self-service device for taking tableware according to claim 2, wherein the support assembly (678) comprises a first bearing block (8) for supporting a tail end of the handle (5*b*) of the tableware (5), a second bearing block (6) and a third bearing block (7) for supporting both sides of the food taking part (5*a*) of the tableware (5); wherein the second bearing block (6) and the third bearing block (7) are respectively arranged in parallel at both sides under the food taking part (5*a*) of the tableware (5) in the bottommost layer, while the first bearing block (8) is arranged under the tail end of the handle (5*b*) of the tableware (5) in the bottommost layer.

4. The self-service device for taking tableware according to claim 3, wherein a guide groove (31) is respectively arranged at both sides of the magazine (3), and the tableware (5) is sequentially stacked along the guide groove (31).

5. The self-service device for taking tableware according to claim 4, wherein a first adjusting and stopping block (10) is arranged at the lower end of the guide groove (31) which is inserted into the tail end of the handle (5*b*) of the tableware (5); wherein the first bearing block (8) is located below the first adjusting and stopping block (10) and a clearance space (505) is formed between the first bearing block (8) and the first adjusting and stopping block (10) to insert the pushing member for pushing the tableware (5) in the bottommost layer; wherein the clearance space (505) is mutually corresponding with the tail end of the handle (5*b*) of the tableware (5) in the bottommost layer; wherein a second adjusting and stopping block (4) is arranged at the lower end of the guide groove (31) which is inserted into a heat end of the food taking part (5*a*) of the inserted tableware, wherein a movement space (506) for a displacement of the food taking part (5*a*) of the tableware (5) in the bottommost layer is formed along a longitudinal direction between the second adjusting and stopping block (4) and the second and third bearing blocks (6, 7); wherein the first adjusting and stopping block (10) and the second adjusting and stopping block (4) are both provided with a first fine adjustment structure (110) for adapting the clearance space (505) and the movement space (506) with a tableware size.

6. The self-service device for taking tableware according to claim 5, wherein the magazine (3) is detachably installed inside the housing body (1), a detachment plate (11) used for sending stacked tableware (5) into the magazine (3) and then being detached is mounted at the bottom of the magazine (3), while a detachment hole (507) for detaching the detachment plate (11) is opened on the guide groove (31) of the magazine (3).

7. The self-service device for taking tableware (5) according to claim 4, wherein the pushing member (9) comprises a pushing rod (91) having one end for pushing the tableware (5) in a bottommost layer, and the other end far away from the tableware (5) in a bottommost layer connected with a pushing button (92), a first inserting hole (14*g*) for inserting the pushing rod (91) is formed on the linkage portion (14*d*), a first abutting wall (501) for abutting the pushing button (92) is provided at one side of the linkage portion (14*d*) facing the pushing button (92), and a second abutting wall (502) for abutting the reset member (12) is provided at the other side of the linkage portion (14*d*) away from the pushing button (92); wherein the magazine (3) is provided with a third abutting wall (503) abutting the reset member (12), a second inserting hole (504) for inserting the pushing rod (91) is opened on the third abutting wall (503); wherein the reset member (12) with both ends abutting the second abutting wall (502) and third abutting wall (503) respectively is sleeved on the pushing rod (91).

8. The self-service device for taking tableware (5) according to claim 7, wherein the magazine (3) is fixedly installed inside the housing body (1), and the guide groove (31) at both sides of the magazine (3) are provided with a second fine adjustment structure (120) for adapting the guide groove (31) with the tableware size; wherein a hollow cavity (400) is mounted at the lower end of the guide groove (31), inside which hollow cavity (400), the first bearing block (8), the second bearing block (6) and the third bearing block (7) are mounted; wherein an end wall at one end of the hollow cavity (400) is the third abutting wall (503); the hollow cavity (400) is further provided with an upper opening and a lower opening, and a clearance space (505) is formed between the first bearing block (8) and a lower end of the guide groove (31) which is inserted into the tail end of the handle (5*b*) of the tableware (5) to insert the pushing member (9) for pushing the tableware (5) in the bottommost layer, wherein the clearance space (505) is mutually corresponding with the tail end of the handle (5*b*) of the tableware (5) in the bottommost layer, wherein a movement space (506) for a displacement of the food taking part (5*a*) of the tableware (5) in the bottommost layer is formed along a longitudinal direction between the lower end of the guide groove (31) which is inserted into the head end of the food taking part (5*a*) of the tableware (5) and the second and third bearing blocks (6, 7).

9. The self-service device for taking tableware (5) according to claim 1, wherein, the stopping plate (14*b*) of the stopper (14) is located at a position where the handle (5*b*) of the tableware (5) stays after sliding along the inclined chute (19); wherein a rotating structure (60) is provided on one side of the stopping plate (14*b*) facing the inclined chute (19) for preventing the tableware (5) from returning during its pulling out; wherein the rotating structure (60) comprises a rotatable holding member (601) for holding the food taking part (5*a*) of the tableware (5) and an inserting hole (602) for passing through the handle (5*b*) of the tableware (5); wherein the rotatable holding member (601) only rotates toward a direction of the stopping plate (14*b*) and resets along the way it comes; wherein a block (603) for preventing the rotatable holding member (601) from rotating in a direction deviating from the stopping plate (14*b*) is arranged on one side of the rotatable holding member (601) deviating from the stopping plate (14*b*).

10. The self-service device for taking tableware (5) according to claim 4, wherein, a lower surface of the pushing portion (9*a*) of the pushing member (9) is provided with a receiving member (70) for receiving the handle (5*b*) of the tableware (5) which is displaced, wherein the receiving member (70) and the pushing member (9) move synchronously with respect to the first bearing block (8); one end of the receiving member (70) is connected with the lower surface of the pushing portion (9*a*) via a connecting piece (701); wherein the other end of the receiving member (70) is a receiving portion (702) formed by projecting relative to an end portion of the pushing portion (9*a*); wherein a movement space (703) for a displacement relative to the first bearing block (8) is formed between the lower surface of the pushing portion (9*a*) and an upper surface of the receiving member (70).

11. The self-service device for taking tableware (5) according to claim 10, wherein, a penetrating hole (704) is provided on the first bearing block (8) for passing through the receiving member (70), the receiving portion (702) of the receiving member (70) is inserted into the penetrating hole (704), and the pushing portion (9*a*) moves along the upper surface of the first bearing block (8), while the receiving member (70) moves along a hole wall of the penetrating hole (704) during the movement.

12. The self-service device for taking tableware (5) according to claim 10, wherein, the receiving member (70) is located at a lower surface of the first bearing block (8), and the pushing portion (9*a*) moves along the upper surface of the first bearing block (8), while the receiving member (70) moves along the lower surface of the first bearing block (8) during the movement.

13. The self-service device for taking tableware (5) according to claim 1, wherein, a prompter (80) for indicating whether the tableware (5) is about to be used up is installed at a side end of the magazine (3).

14. The self-service device for taking tableware (5) according to claim 13, wherein, the prompter (80) comprises a rotating member (801) which automatically rebounds after rotation and is provided with a pressing handle (802) formed by protruding upward from the rotating member (801) for rotating by pressing the stacked tableware (5); wherein the rotating member (801) is provided with a first indication layer (810) for indicating that the tableware (5) is sufficient and a second indication layer (820) for indicating that the tableware (5) is about to be used up at its outer circumferential surface; wherein the rotating member (801) is mounted in a frame body (830), whose outer side is arranged with a display port (803) for displaying the first indication layer (810) and the second indication layer (820); wherein the first indication layer (810) is displayed by rotating the display port (803) via pressing its pressing handle (802) through the stacked tableware (5), while the second indication layer (820) is displayed by an automatic rebound of the pressing handle (802).

15. The self-service device for taking tableware (5) according to claim 14, wherein, one end of the first indication layer (810) is connected with one end of the second indication layer (820).

16. The self-service device for taking tableware (5) according to claim 1, wherein, the housing body (1) is mounted with at least one sliding body (30) on which the magazine (3), the support assembly (678), the inclined chute (19), the pushing member (9) and the stopper (14) are formed on each sliding body (30); wherein a bottom end of each sliding body (30) is slidably connected with the housing body (1) via a sliding mechanism (40).

17. The self-service device for taking tableware (5) according to claim 16, wherein, the sliding mechanism (40) comprises a guide rail (401) formed at a bottom side of the housing body (1) and a sliding groove (301) formed at the bottom end of the sliding body (30), wherein at least one pulley (402) is installed on both sides of the guide rail (301), and moves along the sliding groove (301).

18. The self-service device for taking tableware (5) according to claim 1, wherein, a stopping blocking member (710) is provided for preventing the tableware (5) from turning around is arranged above the inclined chute (19).

* * * * *